United States Patent [19]

Betz

[11] Patent Number: 4,596,628

[45] Date of Patent: Jun. 24, 1986

[54] METHOD FOR MANUFACTURING COMPONENTS OF COMPLEX WALL CONSTRUCTION

[75] Inventor: Wolfgang Betz, Gauting, Fed. Rep. of Germany

[73] Assignee: MTU Motoren-und Turbinen Union Munchen GmbH, Munich, Fed. Rep. of Germany

[21] Appl. No.: 643,066

[22] Filed: Aug. 22, 1984

[30] Foreign Application Priority Data

Aug. 25, 1983 [DE] Fed. Rep. of Germany ..... 3330651

[51] Int. Cl.[4] ..... C23F 1/02; B44C 1/22; C03C 15/00; C03C 25/06

[52] U.S. Cl. ..... 156/630; 156/155; 156/634; 156/644; 156/655; 156/656

[58] Field of Search ..... 156/155, 630, 634, 644, 156/656, 664, 655, 663

[56] References Cited

U.S. PATENT DOCUMENTS

| | | | |
|---|---|---|---|
| 2,619,438 | 11/1952 | Varian et al. | 156/656 X |
| 4,026,746 | 5/1977 | Straw | 156/655 X |
| 4,065,046 | 12/1977 | Roberts et al. | 156/656 X |
| 4,395,303 | 7/1983 | Weir | 156/664 X |

*Primary Examiner*—William A. Powell

*Attorney, Agent, or Firm*—Roberts, Spiecens & Cohen

[57] ABSTRACT

A method for manufacturing components having thin walls of complex design by depositing a layer of metal or ceramic material on a shaped substratum. The resulting coated shaped bodies are then arranged inside an external envelope such that the shaped bodes represent the cavities to be incorporated in the component under manufacture whereas the coatings represent the walls surrounding the cavities. The envelope is then hermetically sealed, evacuated and upon evacuation, subjected to a hot compression operation. Thereafter, the envelope and the shaped bodies are at least partially removed by chemical or mechanical processes. Several layers of various materials and various chemical and physical properties can be deposited on the shaped bodies to form the walls.

20 Claims, 6 Drawing Figures

FIG. 1
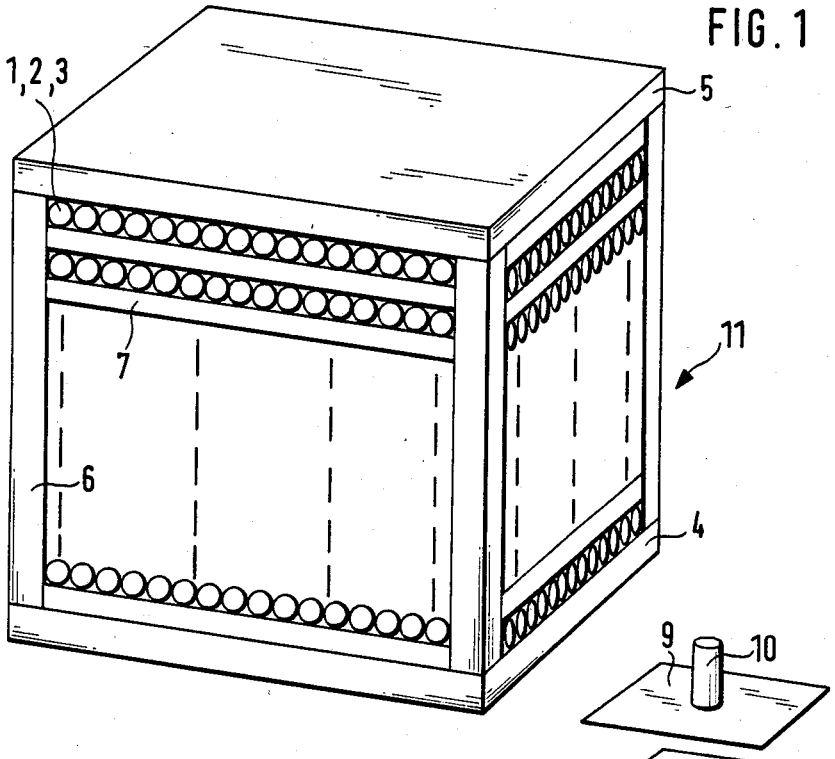
FIG. 2
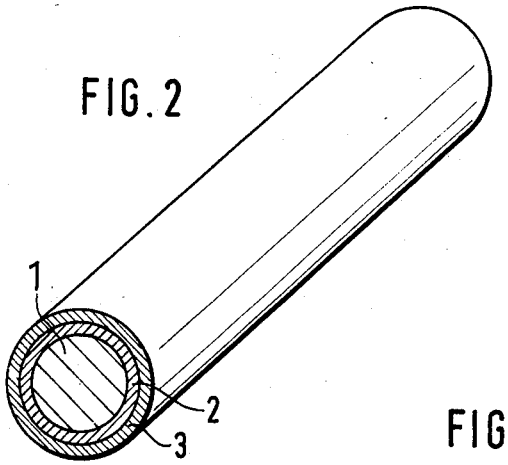
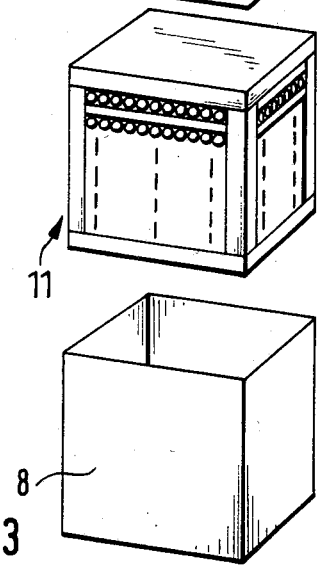
FIG. 3

METHOD FOR MANUFACTURING COMPONENTS OF COMPLEX WALL CONSTRUCTION

FIELD OF THE INVENTION

This invention relates to a method for manufacturing components of complex wall construction by deposition of a thin-walled layer on a substratum.

BACKGROUND

Coating processes, such as the deposition of metallic layers on substrata by brushing, spraying, slurrying, and flame or plasma spraying processes, are generally known. For a good bond of the substratum with the metallic layer and/or for forming a stable metallic layer, the state of the art requires that the layer be deposited on a relatively medium thickness. Thin-walled stable components of complex designs are very difficult to produce in this way with the aid of simple means.

SUMMARY OF THE INVENTION

A broad object of the present invention is to provide a method for manufacturing components of complex wall designs which enables the manufacture of thin-walled components with simple means.

It is a particular object of the present invention to provide a method of manufacturing an article of complex wall construction comprising at least partially coating each of a plurality (at least two) of shaped bodies with at least one thin metallic or ceramic layer and thereafter assembling the plurality of shaped bodies in an arrangement in which the coating layers on the bodies cooperate to form a wall of an article of complex wall construction. The arranged plurality of shaped bodies are then placed in an external container approximately corresponding to the shape of the article and the container is hermetically sealed and evacuated. The evacuated container is then subjected to an external pressurization such as a hot isostatic compression which closes all spaces in the assembly and integrally joins the layers to one another to complete the formation of the article.

The envelope and the shaped bodies are then, at least, partially removed so that the layers which form the wall will surround a cavity formed by the removal of the shaped bodies.

Where breakthroughs are intended in the wall, the shaped bodies are not coated or the wall as formed by the surface layer is removed.

The thin surface layer can be deposited by an electroplating process or as a powder layer by brushing, spraying, or slurrying processes, or as a droplet layer by plasma or flame spraying processes.

The shaped bodies are preferably coated with a layer whose thickness is about one-half the thickness of the intended component wall when substantially compressed; individually coated shaped bodies will then give the intended wall thickness after compression.

In an advantageous aspect of the present invention, several layers of various chemical and physical properties are deposited on the shaped bodies. More particularly, layers of different materials are deposited on the shaped bodies in a manner producing continuous and/or discontinuous transitions. For example, two consecutive nickel-base alloy layers, may be deposited on the shaped body, the first layer being especially resistant to corrosion, and the second to high stresses at high temperatures. The wall of the intended component will, accordingly, be resistant to corrosion externally, and highly heat-resistant internally, making it especially suitable for heat exchanger tubes.

In a further advantageous aspect of the present invention, at least one solid member or powder of the intended wall material is inserted, prior to a pressing operation, in the container or envelope (which may be of glass or sheet metal) between the shaped bodies at places where the component is to have a thicker wall. In the pressing operation this material will be homogeneously united with the remaining coating material to enable the formation not only of thin component walls, but also relatively thick component walls.

For best results, the shaped bodies have the following properties:

ductile at the compression temperature, does not give off gas or liquids in the entire temperature range of hot compression, adapted in strength at the compression temperature to the strength of the coating material, and sufficiently dissimilar in material to the wall material to permit removal of the shaped bodies after compression.

The shaped bodies can be formed to correspond no more than roughly to the cavities to be produced in the component to be manufactured. More particularly, the shaped bodies are premanufactured to have a volume equivalent to that of the cavities to be produced in the component, when the shape of the premanufactured bodies deviates from that of the cavity in the component. The ductility of the shaped bodies enables them to change shape during the compression operation.

The method of the present invention generally contemplates the removal of the envelope and the shaped bodies after the compression operation. However, the envelope and shaped bodies can also be allowed to fully or partially remain in the finished component after the compression operation.

BRIEF DESCRIPTION OF THE FIGURES OF THE DRAWING

The invention will be described more fully hereafter with reference to the accompanying drawing, in which FIG. 1 is a perspective view illustrating a semifinished member of a component manufactured in accordance with the present invention in the form of a cross-flow heat exchanger, FIG. 2 is a fragmentary perspective view, on enlarged scale, of a semifinished member of FIG. 1, FIG. 3 is an exploded view illustrating the semifinished member of FIG. 1 together with additional semifinished members.

DETAILED DESCRIPTION OF PREFERRED EMBODIMENTS

Figure 4:
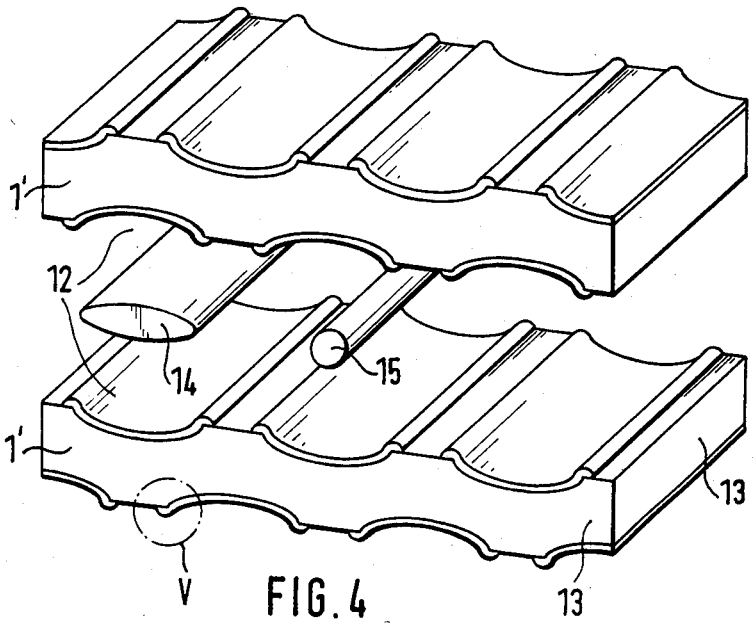
FIG. 4 is a perspective view corresponding to FIG. 2 illustrating a further embodiment of semifinished members.

FIGS. 1 to 3 illustrate various details of semifinished members used in the manufacture of a cross-flow heat exchanger.

In its final arrangement, the cross-flow heat exchanger comprises hollow thin-walled individual tubes arranged in layers in parallel disposition, in which adjacent layers of tubes extend at right angles to one another as illustrated by the semifinished member 11 of the cross-flow heat exchanger of FIG. 1.

Before being arranged as shown in FIG. 1, shaped bodies constituted as individual tubes are treated in accordance with the present invention. With reference now to FIG. 2, each of the shaped bodies comprises a cylindrical rod, made, for example, of iron, the cross-sectional area of which rod roughtly corresponds to the intended inside diameter of a heat exchanger tube. The cylindrical rods are coated all around with layers 2 and 3 of nickel-base powder by plasma spraying. The first layer 2 is formed from a composition giving high resistance to corrosion, while the second layer 3 consists of composition having high resistance to stresses at high temperatures.

The coated rods of FIG. 2 are assembled on a base plate 4 in rows which alternate in direction to form a stacked array of cube shape as shown in FIG. 1. Four nickel-base square rods 6 form corners for the heat exchanger to be formed and serve as a frame for the individual tubes. On top of the uppermost layer of tubes a cover plate 5 is positioned. The base plate 4, the square rods 6 and the cover plate 5 are fixedly connected together. In order to fill the space between the square rods 6 where no shaped bodies are located, additional plates 7 of a suitable size and thickness are inserted at the periphery of the assembly.

The semifinished member 11 is placed in a snugly fitted container or envelope 8, with a cover 9 with a stub pipe 10 positioned on the semifinished body 11. Alternatively, the base plate 4, the square rod 6, the coated shaped bodies 1, the cover plate 5 and the plates 7 are inserted in the rigid envelope 8 to ensure they maintain their relative positions one with respect to the other. The envelope 8 is then hermetically sealed. Its interior is then evacuated through a connection on the stub pipe 10, and upon evacuation the semifinished member 11 is subjected to hot pressurization, in which the envelope 8 is hot isostatically pressurized. This pressurization will close all spaces between the coated rods and the supporting material to unite all individual members. After the compression operation the surfaces of the former cylindrical rods are exposed and the shaped bodies 1 are removed. The resulting product is a cross-flow heat exchanger with thin wall tubes. The walls of the tubes are formed by the layers 2 and 3 extending in alternation in opposite directions.

Figure 5:
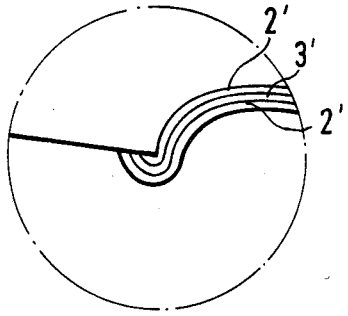
FIG. 5 is an enlarged view of a portion of FIG. 4.
Figure 6:
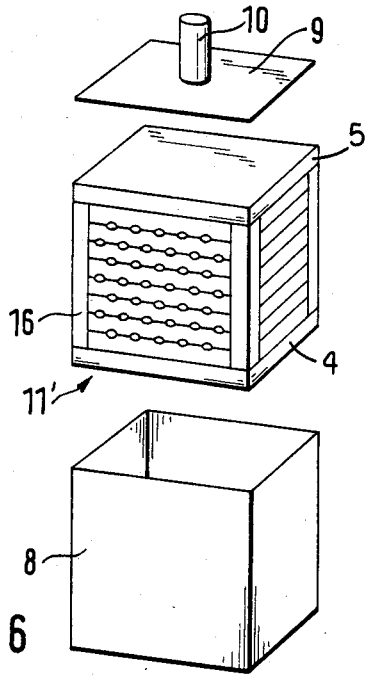
FIG. 6 is a perspective exploded view corresponding to FIG. 3 illustrating semifinished members.

FIGS. 4 to 6 illustrate the manufacture of another embodiment of a cross-flow heat exchanger comprising hollow tubes of elongate or spear-shaped section.

In FIG. 4 are seen shaped bodies 1' in the form of plates serving as the core material used. More particularly, the plates are made of iron and are formed with grooves 12 of a shape corresponding to one-half of the spear-shape tube to be formed. The plates are coated in the grooves, for example, by plasma spraying, such that the coating projects beyond the edges of the groove. The coating is formed by nickel base alloy layers 2', 3', 2' deposited consecutively. The two outer layers 2' are resistant to corrosion, while the intermediate layer 3' is especially resistant to high heat. A coating of the three layers is also deposited on the edges 13 of the plates of the shaped bodies 1'.

The assembly of the stacked plates 1' is then placed in fitted envelope 8. This envelope can be a sheet metal container, for example, made of St 37. The plates are assembled in the stack such that the grooves of two plates will face one another with a preformed insert placed in each groove. The insert may be in the form of spear-shaped rods 14 of uncoated core material or in the form of cylindrical rods of uncoated core material. The cross-sectional area of the insert rods is somewhat (about 5%) smaller than the cross-sectional area of a groove formed by two assembled plates placed on one another. When cylindrical rods 15 are used, it will be of advantage to use rod material of a heat resistance that is slightly lower than that of the plate material.

The inserted rods 14 or 15 protrude slightly, for example, 5 mm beyond the edges of the plates 1'. In the resulting hollow space formed between base 4 and cover 5 are placed strips 16 of a structural material, e.g., on nickel base. They have the same section as the plates. The base 4 and the cover 5 on the stack of plates is of the same structural material. The cover 9 with stub pipe 10 is welded onto envelope 8 after which the envelope, as in the first embodiment, is sealed, evacuated and hot isostatically compressed. After the pressing operation, the envelope 8 and the shaped bodies 1' are chemically removed and the component is processed until finished.

The products manufactured in accordance with the present invention need not only be cross-flow heat exchangers, but they can be any thin-walled sandwich structures, such as, fan blades or curved bodies. The method of the present invention will also permit the manufacture of abradable or thermally insulating coatings using, for example, a ceramic material in a metallic mount.

The invention has been described in relation to specific embodiments thereof. However, it will become obvious to those skilled in the art that numerous modifications and variations can be made within the scope and spirit of the invention if defined by the attached claims.

What is claimed is:

1. A method of manufacturing an article of complex wall construction comprising coating each of a plurality of shaped bodies with a plurality of thin metallic or ceramic layers having different chemical and physical properties, assembling said plurality of shaped bodies in an arrangement in which the coating layers on the bodies cooperate to form a wall of an article of complex wall construction, placing the arranged plurality of shaped bodies in an external container approximately corresponding to the shape of the article, hermetically sealing the container, evacuating the container, subjecting the container to external pressurization while the interior of the container is evacuated, and removing at least partially said container and said shaped bodies to form a cavity having a surrounding wall formed by the layers originally on the shaped bodies.

2. A method as claimed in claim 1 wherein said container and shaped bodies are at least partially removed chemically or mechanically.

3. A method as claimed in claim 1 wherein the layers are applied to the shaped bodies with a thickness equal to about one-half of the thickness of the wall of the article after external pressurization.

4. A method as claimed in claim 1 wherein said plurality of bodies are arranged in rows extending at angles to one another with the coatings on the bodies of one row facing the coatings on the bodies of an adjacent row.

5. A method as claimed in claim 1 wherein said layers are of different material.

6. A method as claimed in claim 1 wherein prior to the pressurization at least one solid member or powder of the desired wall material is inserted into the container between the shaped bodies in regions where the wall is to be made thicker.

7. A method as claimed in claim 1 wherein said shaped bodies are made from a material which at the pressurization temperature is ductile and produces no gases or liquids.

8. A method as claimed in claim 1 wherein said shaped bodies are made from a material having a strength approximately equal to or lower than that of the coating layers.

9. A method as claimed in claim 1 wherein, upon removal, said shaped bodies form cavities of tubular shape in the wall of the manufactured article.

10. A method as claimed in claim 1 wherein the article is a cross-flow heat exchanger with two groups of flow passages extending at angles to one another, the coating layers on the shaped bodies defining cavities in the wall of the manufactured articles, after removal of the shaped bodies, extending in different directions to provide said two groups of flow passages.

11. A method as claimed in claim 1 wherein said external pressurization comprises hot isostatic pressurization applied uniformly around said container.

12. A method of manufacturing an article of complex wall construction comprising coating a portion of each of a plurality of shaped bodies with at least one thin metallic or ceramic layer to provide coated and bare parts of said bodies, assembling said plurality of shaped bodies in an arrangement in which the coating layers on the bodies cooperate to form a wall of an article of complex wall construction, placing the arranged pluraltiy of shaped bodies in an external container approximately corresponding to the shape of the article, hermetically sealing the container, evacuating the container, subjecting the container to external pressurization while the interior of the container is evacuated, and removing at least a portion of said container and said shaped bodies to form cavities having a surrounding wall constituted by the layers originally on the shaped bodies.

13. A method as claimed in claim 12 wherein said container and shaped bodies are at least partially removed chemically or mechanically.

14. A method as claimed in claim 12 wherein the layers are applied to the shaped bodies with a thickness equal to about one-half of the thickness of the wall of the article after external pressurization.

15. A method as claimed in claim 12 wherein a plurality of said layers are applied to the shaped bodies, the layers having different chemical and physical properties.

16. A method as claimed in claim 12 wherein a plurality of said layers are applied to the shaped bodies, the layers being of different material.

17. A method as claimed in claim 12 wherein prior to the pressurization at least one solid member or powder of the desired wall material is inserted into the container between the shaped bodies in regions where the wall is to be made thicker.

18. A method as claimed in claim 12 wherein the article is a cross-flow heat exchangeer in which after removal of the shaped bodies the coating layers on the shaped bodies define first and second groups of isolated cavities in the wall of the manufactured article constituting said two groups of flow passages.

19. A method as claimed in claim 12 wherein said external pressurization comprises hot isostatic pressurization applied uniformly around said container.

20. A method as claimed in claim 12 wherein said plurality of bodies are constituted as plates arranged one on top of the other with the coatings on one plate facing the coatings on the adjacent plate.

* * * * *